United States Patent [19]

Denizman

[11] 4,141,550

[45] Feb. 27, 1979

[54] TENNIS SERVE TRAINING DEVICE

[76] Inventor: Nejat H. Denizman, 676 W. Diversey Ave., Chicago, Ill. 60614

[21] Appl. No.: 832,585

[22] Filed: Sep. 12, 1977

[51] Int. Cl.[2] ..... A63B 61/00

[52] U.S. Cl. ..... 273/29 A

[58] Field of Search ..... 273/29 R, 29 A, 1.5 A, 273/1.5 R, 102 R; 35/29 R

[56] References Cited

U.S. PATENT DOCUMENTS

| | | | |
|---|---|---|---|
| 3,117,183 | 1/1962 | Chalfroft | 273/1.5 R |
| 3,348,840 | 10/1967 | Dix | 273/1.5 A |
| 3,602,504 | 8/1971 | Chapman | 273/1.5 R |
| 4,023,798 | 5/1977 | Pronin | 273/29 A |

*Primary Examiner*—Richard C. Pinkham
*Assistant Examiner*—T. Brown
*Attorney, Agent, or Firm*—Wegner, Stellman, McCord Wiles & Wood

[57] ABSTRACT

A practicing device for use in developing and maintaining an accurate tennis serve. The device includes a carrier defining a downwardly open apex space, a support for supporting the carrier with the apex space disposed at the top of the path of a tennis ball properly tossed by the user in a simulated serving action, a flexible element underlying the apex base and arranged to be urged upwardly into the apex space by a tennis ball tossed upwardly to the apex space, and a signal device for providing a signal in the event the tennis ball is tossed incorrectly either upwardly through the apex space or laterally adjacent the apex space. The signal device may provide an audible signal. The support may be arranged for selectively supporting the practicing device either on the ground or on the elevated mounting. The flexible element further serves as an indicator for indicating that the tennis ball was properly tossed in the simulated serving action.

16 Claims, 5 Drawing Figures

FIG. 1
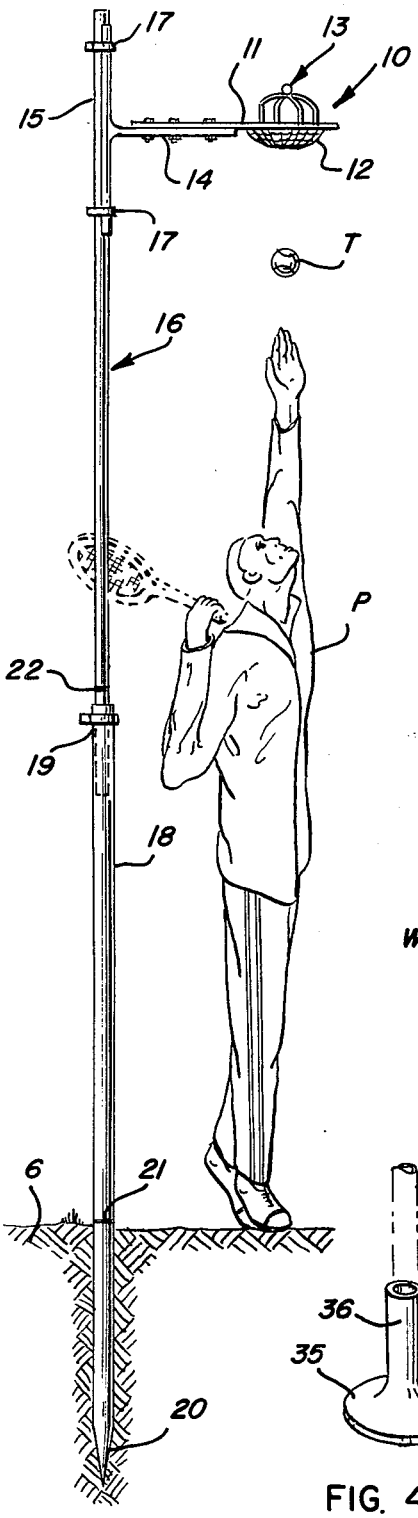
FIG. 2
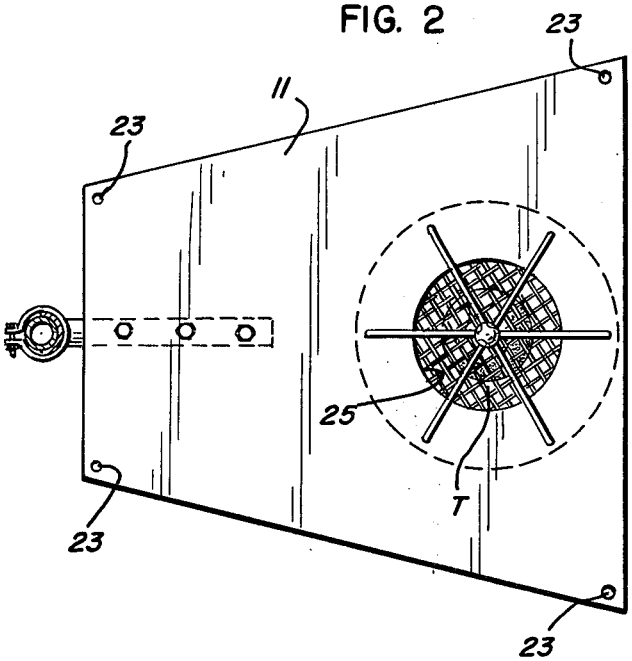
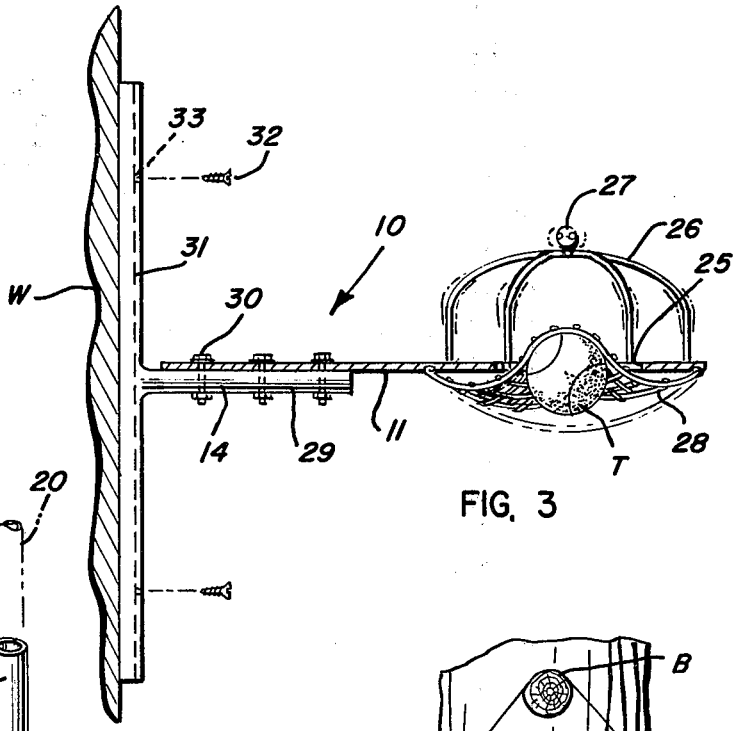
FIG. 3
FIG. 4
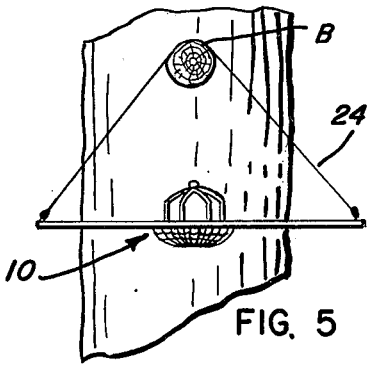
FIG. 5

TENNIS SERVE TRAINING DEVICE

BACKGROUND OF THE INVENTION

One very important aspect of the game of tennis is the proper serving of the ball. It is well understood in the playing of the game that the server has an advantage, and all other things being equal, should win the served game. Thus, it is important for the player of the game to develop a perfected serve.

One of the important aspects of a tennis serve is the tossing of the ball. In order to provide optimum strength and accuracy in the serve, the toss of the ball must be accurately controlled to provide optimum striking of the ball by the server's racket at the precisely accurate time in the ball toss to effect an accurate, forceful serve of the ball to the opponent's service court.

The toss of the ball in such a tennis serve defines a trajectory having a top at which the ball is struck by the server's racket in effecting the serve. The desideratum in connection with such a ball toss is that the top of the toss be accurately at the center of the racket when the racket is swung slightly beyond its uppermost position forwardly and downwardly so as to be perpendicular to a line drawn from the service court over the net to the face of the server's racket. Thus, if the server effects an accurate toss of the ball, the racket will strike the ball at the top of the ball toss with the racket accurately disposed for serving the ball to the service court.

The present invention is concerned with a practicing device for permitting a tennis player to simulate the serving of a tennis ball by tossing the ball in a simulated serving action with means for indicating the correctness of the ball toss. The device permits the repeated practicing of the serve without actual striking of the ball with a racket whereby the practicing may be effected independently of the tennis court and without the need for retrieving served tennis balls, as only a single ball is required for permitting repeated and continuous serving practice.

SUMMARY OF THE INVENTION

More specifically, the invention comprehends the provision of such a tennis serve practicing device including a carrier defining a downwardly open apex space, means for supporting the carrier with the apex space disposed at the top of the path of a tennis ball properly tossed by the user in a simulated serving action, a flexible element underlying the apex space arranged to be urged upwardly into the apex space by a tennis ball tossed upwardly to the apex space, and signalling means for providing a signal in the event the tennis ball is tossed incorrectly (a) upwardly through the apex space, or (b) laterally adjacent the apex space.

The signalling means may comprise means for providing an audible signal, and more specifically, in the illustrated embodiment, comprises a bell. Alternatively, the signalling means may comprise a visual indicator, such as a light, etc.

The supporting means may comprise an upright and means for supporting the carrier on the upright at a preselected height above the ground level whereby the apex zone of the device is located accurately at the top of the user's serving toss ball path.

The carrier may comprise a plate having a hole defining the apex space with the flexible element being supported on the carrier to extend to below the hole so as to be engaged by the ball at the top of the serving toss.

The signalling device may be disposed superjacent the carrier hole and may be mounted to the carrier.

The support means may include an extensible upright portion and the means for locking the upright portion in an adjusted arrangement with the carrier disposed at the desired accurate preselected height. Alternatively, the supporting means may comprise a hanger for hanging the carrier on a superior mounting means, such as the limb of a tree, garage eave, etc.

In the illustrated embodiment, the carrier defines a circular hole having a diameter slightly greater than the diameter of the tennis ball so as to require an accurate toss of the ball not only as to the height of the top of the toss but also as to the location of the top of the toss.

In the illustrated embodiment, the flexible element comprises a net hanging from the carrier to extend under the carrier hole.

In the illustrated embodiment, the carrier includes a removable mounting bracket and means for mounting the bracket selectively to the supporting means of the device.

In one form, the supporting means defines a sharp lower end portion arranged to be forced into the ground. A mounting stand may be provided having a tubular upright socket for selectively receiving the lower end of the support for alternatively mounting the device on a hard surface such as that of the driveway.

Thus, the tennis serve practicing device of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is a side elevation of a practicing device embodying the invention;

FIG. 2 is a fragmentary enlarged horizontal section of the device;

FIG. 3 is a fragmentary enlarged vertical section thereof;

FIG. 4 is a perspective view of a stand for use in mounting the device on a hard surface; and FIG. 5 is a front elevation of the device carried on an overhanging tree limb.

DESCRIPTION OF THE PREFERRED EMBODIMENT

In the exemplary embodiment of the invention as disclosed in the drawing, a tennis serve practicing device generally designated 10 is shown for use in developing and maintaining an accurate tennis serve of a player P. The device is arranged so as to provide an indication to the player of the accuracy in tossing of the tennis ball T in simulated serving action, thereby permitting the player to repeatedly and continuously practice his tennis serve with a single tennis ball T and without the need for actually striking the tennis ball in practicing the serve.

More specifically, as shown in FIG. 1 of the drawing, device 10 includes a carrier 11 provided with a flexible element 12 and a signalling device generally designated 13.

Carrier 11 may include a removable mounting bracket 14 which, in turn, may be mounted to the upper end 15 of a support 16 by suitable means, such as clamps 17.

Support 16 may comprise an extensible support having a lower portion 18 and means 19 for telescopically receiving and locking the upper portion 15 to the lower portion 18 in adjusted vertical disposition, as shown in FIG. 1.

Lower support portion 18 may be provided with a sharp distal lower end 20 adapted to be forcibly inserted into the ground G to dispose the support in a vertical arrangement, as shown in FIG. 1.

To facilitate installation of the device, the lower support portion 18 may be provided with an indicating band 21 for indicating the full penetration of the lower portion 20 of the support into the ground. Upper portion 15 may be provided with a similar indicating band 22 for cooperation with the locking adjustment means to indicate the proper telescopic extension of the upper portion 15 relative to the lower portion to mount the carrier 11 at a preselected, or predetermined, elevation.

As further illustrated in FIG. 1, the predetermined elevation of the practicing device is one wherein an indication of the proper serving of the tennis ball T is effected in a simulated tennis serving action. To determine this disposition, the player initially determines the disposition of his racket when the face of his racket is properly inclined at the desired point of impact with the tennis ball in effecting a desired serve of the ball to the opposite service court. Once this position is determined, the player may then adjust the support 16 to position the practicing device 10 accurately in correspondence therewith. Similarly, the proper location of the player's feet in effecting the desired serve of the tennis ball subjacent the practice device 10 may be determined and marked. Once the device is arranged in this manner, as shown in FIG. 1, the player may then repeatedly toss the tennis ball T upwardly to the practice device 10 without an actual tennis racket being utilized to effect a simulated tennis serve. Thus, the practice device concentrates on obtaining an accurate toss of the ball which, as indicated above, is a most important aspect of the serving action.

Referring now to FIGS. 2 and 3, carrier 11 may be seen to comprise a flat plate formed of any suitable rigid material. The plate may be provided with suitable holes 23 at the corners thereof, such as for use in securing a hanger cord 24 to the carrier as for supporting the carrier on a tree branch B in lieu of support 16, as illustrated in FIG. 5.

Carrier plate 11 may be provided with a suitable hole 25 adapted to pass the tennis ball T upwardly therethrough with relatively small clearance. In the illustrated embodiment, the hole 25 has a diameter of approximately 4½ inches.

Mounted on carrier 11 is a cage 26 provided with a signalling device 27 which, in the illustrated embodiment, is arranged to provide an audible signal of an incorrectly tossed ball. As shown in FIG. 3, the signalling device may comprise a bell device mounted to the top of the cage 26 to be disposed superjacent the center of hole 25 in the carrier plate.

Practicing device 10 further includes a flexible element 28 adapted to be urged upwardly by the tennis ball T at the top of the ball toss. The flexible element herein comprises a net which underlies the hole 25 and which is urged upwardly through the hole when the ball T is properly tossed to the desired disposition as shown in FIG. 3. Thus, the net 28 serves as means for indicating to the user a proper toss of the ball to the desired height.

The flexible element is arranged so as to permit the movement thereof into the opening 25, as shown in FIG. 3, without actuating the signalling device 27 when the top of the ball served is substantially at the opening 25, as shown in FIG. 3. However, in the event the ball is tossed inaccurately too high, the net is drawn fully upwardly into the hole 25 causing a sudden jerking movement of the carrier 11 and operation of the signalling device 27 to indicate to player P that the ball toss was not accurately correct.

Similarly, should the toss of the ball cause the ball to be displaced laterally relative to the hole 25, the net will permit the ball to strike the underside of the carrier circumjacent hole 25 to again cause actuation of the signal device 27 indicating to the player P of the inaccuracy in that ball toss.

Still further, should the player toss the ball with insufficient height so as to not suitably engage the net 28, the failure of the net to be moved upwardly by the ball serves as a further indication to the player of the inaccuracy of the ball toss.

Thus, the use of the device indicates a properly tossed ball in the simulated tennis serving action when the net 28 is brought upwardly into the hole 25 without causing operation of the signalling device 27. Such practicing may be repeatedly effected in a continuous manner by the player catching the tossed ball upon its falling downwardly from the device 10 and then initiating a subsequent serving toss.

Mounting bracket 14, as best seen in FIG. 3, may include a horizontal portion 29 to which the carrier may be removably secured as by bolts 30. The bracket may further include an upright portion 31 adapted to be secured to a mounting means, such as a wall W of a building or the like, as by suitable screws 32 passed through suitable openings 33 in the portion 31.

As further illustrated in FIG. 4, the practicing device may include a stand 34 having a relatively heavy bottom portion 35 and an upwardly projecting tubular portion 36 adapted to receive the lower end 20 of the support portion 18 so as to support the practicing device on the surface, such as the surface of a driveway or the like.

Thus, when the ball T is properly tossed in a simulated tennis serve, the ball will be disposed at the center of hole 25 at the top of its trajectory, or apex, whereby hole 25 defines an apex space into which the ball is received in a proper serving toss. Such a toss is indicated to the user by the upward swinging of the net 28 by the ball at the top of the toss. Deviation from this correct toss is signalled to the user either by the ringing of the bell 27 or the failure to bring the net 28 upwardly to the position shown in FIG. 3.

In the illustrated embodiment, the bell 27 is disposed approximately 4 inches above the level of the carrier plate 11 and the net is arranged to sag approximately 2 inches to below the center of the opening 25. In the illustrated embodiment, the net comprised a relatively lightweight nylon net. The carrier plate had a dimension of approximately 16 inches in length and approximately 16 inches in maximum width. Support 16 was arranged to have a maximum extended length of approximately 12 feet with the sharp tip 20 of the support having a length of approximately 8 inches. The height of the upright portion 36 of stand 34 was approximately 12 inches.

The device may be erected and adjusted by the player alone, or with the help of an observer or coach. Once the device is adjusted for the particular player P, the player may utilize the device repeatedly in effecting the practice serves. The use of the indicating bands 21 and 22 permits the ready assembly and disassembly of the structure with the device being readily restored to the adjusted disposition when reassembled.

Thus, the practicing device of the present invention is extremely simple and economical of construction while yet providing an improved facilitated practicing of the tennis serve and permitting the use thereof in relatively small spaces without the need for practicing the serve on an actual tennis court or the like and without the need for retrieving of served tennis balls in effecting the desired practice.

The foregoing disclosure of specific embodiments is illustrative of the broad inventive concepts comprehended by the invention.

I claim:

1. A practicing device for use in developing and maintaining an accurate tennis serve ball toss, said device comprising:

a carrier defining a downwardly open space;

means for supporting the carrier with said space disposed at a position corresponding to the top of the path of a tennis ball properly tossed by the user in a simulated serving action;

a flexible element extending fully transversely across and below said space and being arranged to be urged upwardly into said space by a tennis ball tossed upwardly thereto; and signalling means for providing a signal in the event a tennis ball is tossed incorrectly (a) upwardly through said space sufficiently to carry said flexible element therewith upwardly through said space to cause a sudden movement of the carrier, or (b) laterally adjacent said space to impact against said carrier to cause a sudden movement of the carrier.

2. The tennis serve practicing device of claim 1 wherein said signalling means comprises means for providing an audible signal.

3. The tennis serve practicing device of claim 1 wherein said signalling means comprises a bell.

4. The tennis serve practicing device of claim 1 wherein said supporting means comprises an upright and means for supporting the carrier on the upright at an adjusted height above the ground whereby said space is located accurately at the top of the user's proper serving toss ball path.

5. The tennis serve practicing device of claim 1 wherein said carrier comprises a plate having a hole defining said space.

6. The tennis serve practicing device of claim 1 including means for mounting said flexible element to said carrier.

7. The tennis serve practicing device of claim 1 wherein said flexible element comprises a flexible net.

8. The tennis serve practicing device of claim 1 wherein said signalling means comprises a signalling device mounted to a top portion of said carrier.

9. The tennis serve practicing device of claim 1 wherein said signalling means comprises a signalling device mounted to said carrier to be disposed directly above said space.

10. The tennis serve practicing device of claim 1 wherein said supporting means comprises an extensible upright and means for locking the upright in an adjusted arrangement with the carrier supported on the upright at a preselected height above the ground whereby said space is located accurately at the top of the user's proper serving toss ball path.

11. The tennis serve practicing device of claim 1 wherein said supporting means comprises hanger means for hanging the carrier.

12. The tennis serve practicing device of claim 1 wherein said carrier comprises means defining a circular hole having a diameter slightly greater than the diameter of a conventional tennis ball and defining said space.

13. The tennis serve practicing device of claim 1 wherein said carrier comprises means defining a circular hole having a diameter slightly greater than the diameter of a conventional tennis ball and defining said space, and said flexible element comprises a flexible net carried by said carrier and underlying said hole.

14. The tennis serve practicing device of claim 1 wherein said carrier includes a removable mounting bracket and means for mounting the bracket selectively to said supporting means.

15. The tennis serve practicing device of claim 1 wherein said supporting means comprises an upright having a sharp lower end, and a mounting stand having a tubular upright socket selectively receiving said lower end.

16. The tennis serve practicing device of claim 1 wherein said supporting means comprises an upright having a sharp lower end.

* * * * *